United States Patent [19]

Little

[11] 4,185,559

[45] Jan. 29, 1980

[54] AMPLIFIER FOR MISSILE DETONATOR

[75] Inventor: William R. Little, Seattle, Wash.

[73] Assignee: The United States of America as represented by the Secretary of the Navy, Washington, D.C.

[21] Appl. No.: 294,773

[22] Filed: Jul. 12, 1963

[51] Int. Cl.[2] ..... F42C 13/00

[52] U.S. Cl. ..... 102/211; 102/18 R

[58] Field of Search ..... 102/18, 19.2, 70.2, 102/211

[56] References Cited

U.S. PATENT DOCUMENTS 3,162,119 12/1965 Tate, Jr. et al. ..... 102/18

*Primary Examiner*—Charles T. Jordan

*Attorney, Agent, or Firm*—Richard S. Sciascia; J. M. St.Amand; Howard J. Murray

EXEMPLARY CLAIM

1. In a circuit for detonating a projectile at its point of closest approach to a target toward which the projectile has been launched, said projectile incorporating a sensor for developing an electrical wave which increases in magnitude as the projectile approaches the target and then drops to zero at the point of closest approach of the projectile to the target in the event that there is no contact therebetween, said circuit comprising:

(a) a balanced push-pull input amplifier receiving the electrical wave developed by said sensor and acting to generate a signal output of negative polarity as the said electrical wave drops to zero following a rise in amplitude as the projectile approaches its target;

(b) a clipper-amplifier to which the signal output of said push-pull input amplifier is applied, said clipper-amplifier being initially cut off and being rendered conductive by the application thereto of the output of said push-pull amplifier to develop a square-wave voltage;

(c) a phase inverter connected to said clipper-amplifier and providing positive feedback thereto;

(d) an energy-storage device receiving the square-wave voltage developed by said phase inverter and acting to generate a firing signal;

(e) a power switch actuated to closed position by the firing signal produced by said energy-storage device when said firing signal has reached a predetermined value;

(f) a projectile detonator;

(g) and a network including said projectile detonator and said pour switch, said network being energized by the closing of said power switch to detonate said projectile.

5 Claims, 6 Drawing Figures

AMPLIFIER FOR MISSILE DETONATOR

The present invention relates to missiles, and more particularly to an electrical circuit through the use of which a missile is caused to explode when it reaches the closest point of approach to a target.

Various devices are now employed to bring about the explosion of a missile, such as an underwater torpedo, which has been launched toward a target. Perhaps the best known of such devices is one which operates when the missile impacts its objective. Other arrangements operate on the "proximity" principle—that is, a voltage is generated which increases as the missile approaches a target, and, when the amplitude of this energy reaches a predetermined threshold level, a firing signal is initiated.

Both of these designs possess certain drawbacks. In a system which relies upon actual contact between the projectile and its target, there is present the obvious possibility that the missile may follow a course which causes it to miss its objective, in which case no explosion will occur. On the other hand, systems which employ the "proximity" principle do not necessarily bring about an explosion at the point of closest approach, since the instantaneous value of the generated voltage can vary according to such target characteristics as size and orientation, either or both of which may be unknown or uncalculable. Consequently, a premature detonation of the torpedo may occur too far away from the target to produce any extensive damage.

It is an objective of the present invention to provide a so-called "short-range influence exploder" for use in a projectile such as a torpedo, the disclosed system being designed to initiate a firing signal in close proximity to the target—for example, at a distance of less than two feet. Still further, the invention concept incorporates a "nearest approach" principle—that is, a firing signal is initiated when the torpedo either (1) hits the target or (2) reaches the closest point of approach thereto.

Certain requirements have been taken into consideration in the design of the mechanism herein set forth. Among these requirements are (a) the electrical control system shall actuate the torpedo detonator when the center of the warhead is at approximately its point of closest approach to the target, (b) the electrical circuitry shall not actuate the detonator when the center of the warhead is at a distance greater than two feet (for example) from the target, (c) the system shall have a reliability of at least 99 percent, (d) the system shall not only provide capability against a target of some material such as steel, but also capability against a non-magnetic conductive target material such as aluminum, and (e) the control circuitry shall obtain its operating energy from the torpedo power supply.

It is an important characteristic of the detonator control circuit herein disclosed that the detonator activation is initiated not when the signal voltage first rises above the "triggering level" but instead when the voltage later falls below this level. This insures a detonation of the explosive charge when the torpedo is at its closest point of approach to the target, since the generated voltage begins to fall immediately following such point of closest approach. Another feature of the invention circuitry is its sensitivity to an input signal waveform of either polarity. This means that it will be effective against a target composed of either steel or some conductive non-magnetic material such as aluminum. Other secondary differences between the invention exploder circuitry and those already known are the increased sensitivity of the pick-up device, the isolation (for DC) of the detonator circuit power supply from that which supplies energy to the control circuit, and, finally, the ability of the control circuitry to operate from a power supply having the same characteristics as that of the torpedo propulsion power source, thereby reducing space and weight requirements.

One object of the present invention, therefore, is to provide an improved circuit for controlling the detonation of a missile so that such detonation will occur either when the missile impacts a target or when the missile is at its point of closest approach thereto.

Another object of the invention is to provide a circuit for controlling the detonation of a torpedo, such circuit being operative against targets composed of electrically-conductive material of either a magnetic or a non-magnetic nature.

A further object of the invention is to provide a circuit for controlling the detonation of a torpedo, which circuit possesses a high degree of resistivity to any spurious signals such as noise which may be picked up by the target sensing unit.

A still further object of the invention is to provide a device of the type described which is not subject to undesired activation as a result of mechanical shock such as that occurring at water entry, from countermining explosions, or from the unintentional striking of nonmetallic objects.

An additional object of the invention is to provide a device of the type described which is insensitive to maneuvering accelerations of the vehicle, and which furthermore may be fabricated of more or less standard components and without the necessity of adhering to close mechanical tolerances.

Other objects, advantages, and novel features of the invention will become apparent from the following detailed description of the invention when considered in conjunction with the accompanying drawings wherein.

Figure 1:
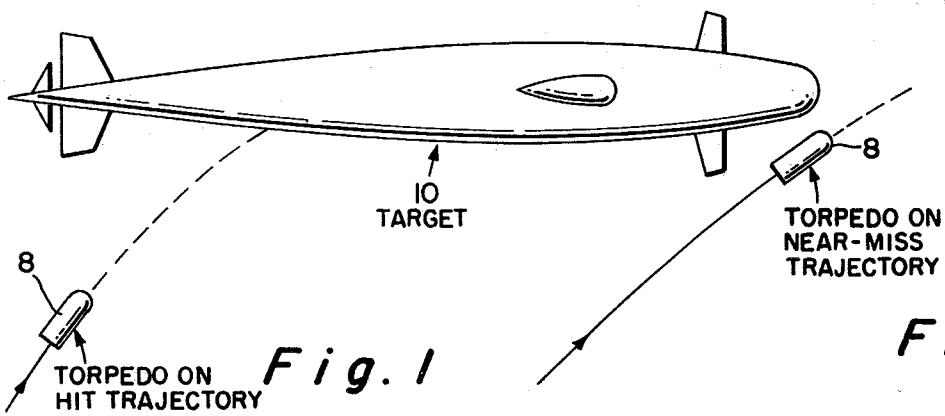
FIG. 1 is a schematic showing of one typical trajectory which might be followed by an underwater missile or torpedo of the type to which the present invention relates, such underwater missile being launched toward a target such as a submarine.

As set forth above and shown in FIG. 1 of the drawings, the present invention is designed for incorporation into a missile 8 which is intended to be launched toward a selected target such as the submarine 10. The missile, in this case a torpedo, incorporates means for sensing its proximity to the target 10 and for detonating a charge when it reaches the point of nearest approach thereto.

Figure 2:
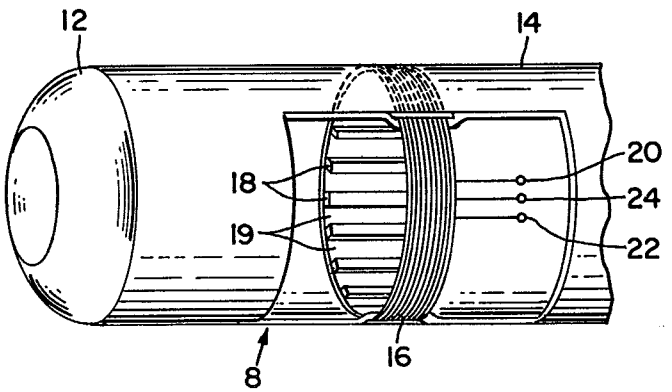
FIG. 2 is a schematic showing of a portion of a torpedo designed in accordance with the present concept, the surface covering of the torpedo being partly broken away to illustrate a portion of the target-sensing apparatus.

One preferred apparatus for sensing the relative position of missile 8 and target 10 is set forth in FIG. 2 of the drawings. The missile 8 is provided in the usual fashion with a nose section 12 and a warhead section 14 in which an explosive charge (not shown) is located. To provide signals for application to the control circuitry of the present invention, the warhead section 14 of the missile includes a sensing unit in the form of a detection coil. Although this unit forms no part of the present invention, one preferred arrangement would include a coil of wire 16 wound so as to overlie a plurality of spaced-apart bar magnets 18 each disposed longitudinally of the torpedo and preferably embedded in a magnetically-non-permeable, electrically-non-conductive, body 19 of some such material as plastic or fiberglass. As shown in FIG. 2, the coil 16 is so wound so as to have an axis which coincides with the longitudinal axis of torpedo 10. It has two output terminals 20 and 22 together with a center tap 24.

Figure 3:
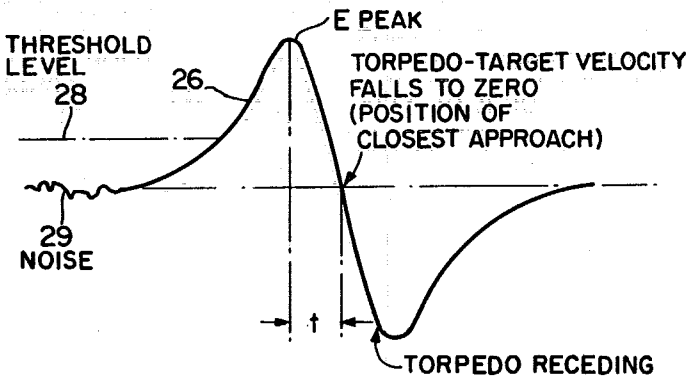
FIGS. 3 and 4 are wave forms of typical voltages which might be derived from the sensing unit of FIG. 2.
Figure 4:
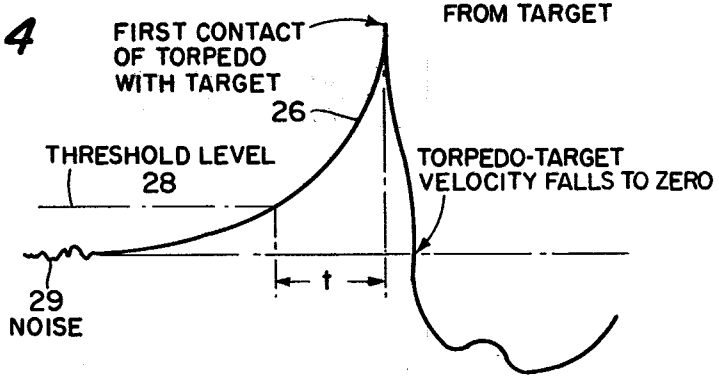

The sensing unit of the missile, as shown in FIG. 2, is intended to provide a signal of varying amplitude as the missile reaches the vicinity of an intended target. Although the character of this signal will vary considerably for missiles of different designs and for targets of different sizes and configurations, nevertheless two somewhat idealized waveforms for a typical impact situation and for a "near miss" are shown in FIGS. 3 and 4, respectively. In this connection it should be understood that, as the missile approaches its target, the voltage output 26 of the detection coil 16 continues to rise. If actual impact occurs and the firing voltage level 28 has not been reached, exploder activation will take place. However, in the event that the missile does not impact the target, the voltage output 26 of the coil 16 does not rise indefinitely, but instead reaches a maximum value at a point identified as $E_{peak}$ in FIG. 4, followed by a rapid decline to zero volts at the point of closest approach, and a large negative voltage as the torpedo recedes from the target. Although forming no part of the present invention, it might be mentioned that the maximum value of $E_{peak}$ depends upon the slope of the wave 26, upon the distance between the missile and target at the point of closest approach, and on the velocity of the missile. For a given miss distance, the peak voltage decreases with decreasing missile velocity, and is also a direct function of the slope of the voltage wave.

As shown in FIG. 3, the output voltage 26 of coil 16, after reaching a peak value, decreases rapidly to zero, and the time t required therefor depends upon the same variables listed above. For a given miss distance, the product of the fall time t and the peak voltage $E_{peak}$ is approximately constant regardless of variations in missile velocity and in the slope of the voltage wave, even though the values of t and $E_{peak}$ are themselves not constant. The conclusion to be drawn by the above is that the maximum value of t occurs for the minimum value of $E_{peak}$, and that, in turn, occurs at minimum missile velocity and for a voltage wave having a maximum radius of curvature.

FIG. 4 indicates the conditions which prevail when the missile impacts the target. As shown therein, the voltage output of coil 16 continues to increase until impact occurs, at which time this voltage falls irregularly to zero and then has a varying negative amplitude during the time that the torpedo is rebounding. It will be noted that the curves of FIGS. 3 and 4 are similar in that a maximum positive voltage is reached followed by a fairly rapid decline to zero, which occurs either when the missile actually impacts the target or passes in close proximity thereto.

Figure 5:
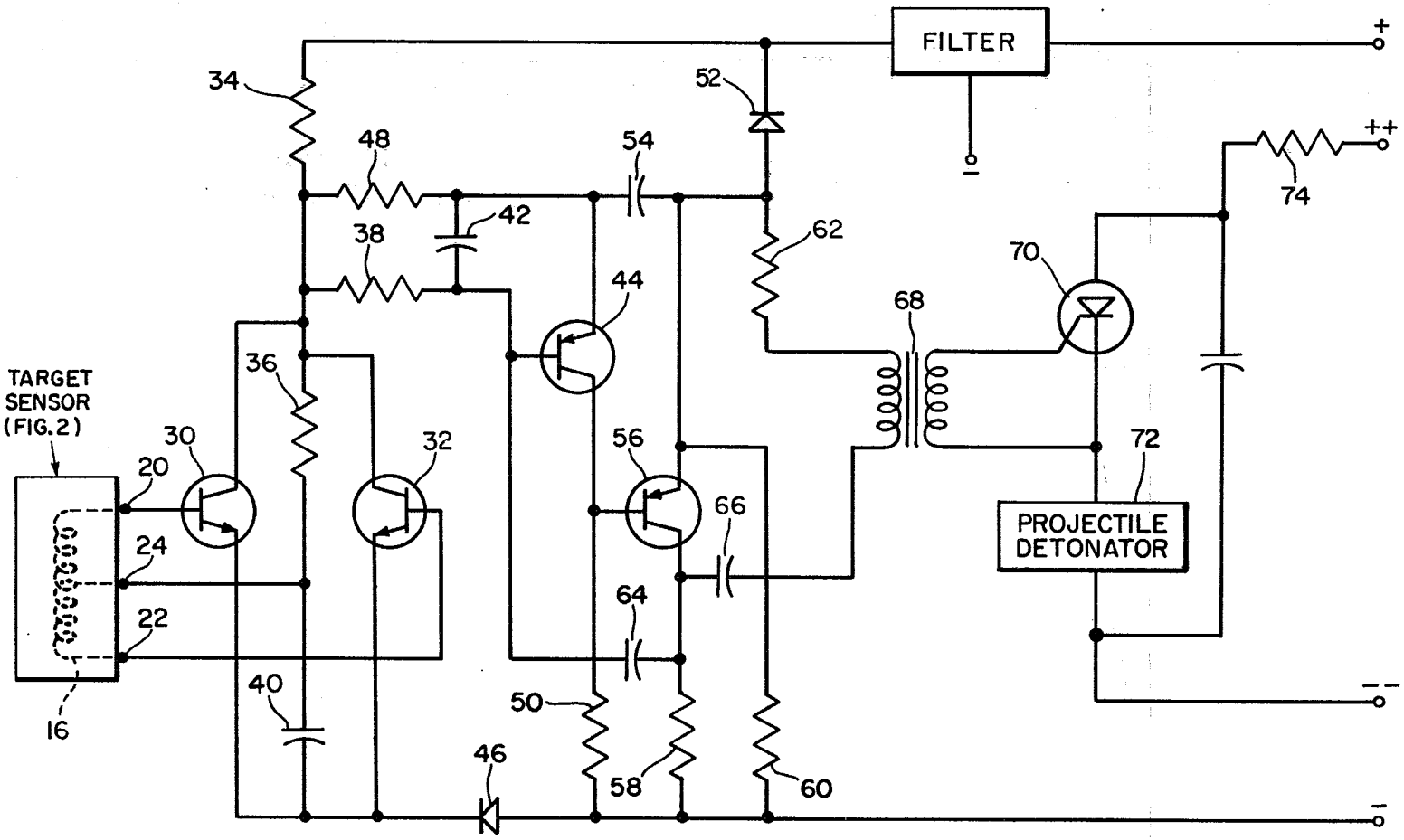
FIG. 5 is a circuit diagram of an amplifier circuit designed in accordance with the present invention, such circuit receiving energy from the sensing unit of FIG. 2.

It is again emphasized that the design and operating features of the coil of FIG. 2 form no part of the present concept, and are being set forth merely to serve as an explanation of one manner in which a signal voltage variation may be developed for application to the invention circuitry of FIG. 5. It might be further mentioned, however, that the possibility is present that various spurious signals such as noise will be picked up by the coil 16. These random voltage variations are represented by the reference numeral 29 in FIG. 3. For example, there are various noise sources in the torpedo itself, as well as noise due to maneuvering of the torpedo in the Earth's magnetic field. However, for a given design of the coil 16, there can be predicted a certain background noise voltage level which is at all times below the predetermined firing threshold level 28 by a selected margin of safety. Expressed differently, the coil 16 is so designed that all bona fide signal voltages will exceed by a substantial margin the expected amplitude of the noise variations 29.

Referring now to FIG. 5 of the drawing, there is illustrated a preferred control circuit for receiving and utilizing the output of the sensor of FIG. 2. Although the circuit of FIG. 5 is intended to operate with input signals of the type described in connection with FIGS. 3 and 4, nevertheless it is not limited to any particular apparatus by means of which these signals are developed. For convenience of description, the output of coil 16 of FIG. 2 is shown as being supplied to a pair of transistors, or similar semi-conducting elements, 30 and 32, the output terminal 20 of the coil being connected to the base electrode of transistor 30, and the output terminal 22 of coil 16 being connected to the base electrode of transistor 32. The arrangement is thus that of a push-pull amplifier.

Before proceeding further with a description of the circuit of FIG. 5, it is believed that certain operating requirements for this portion of the invention should be indicated. It has been stated that the short-range influence detection coil 16 of FIG. 2 produces a signal voltage which is a function of both missile-target closing velocity and separation distance, and has representative wave forms that are ideally shown in FIGS. 3 and 4, respectively, for near-miss and actual impact with a permeable target. For a non-magnetic but conductive target (such as aluminum, for example) a similar wave form of opposite polarity is produced. As brought out in the drawings, this energy rises to some maximum value $E_{peak}$ and then falls to zero, the zero cross-over point occurring at the closest approach of the missile to the target. Consequently, in order to achieve the required sensitivity factor together with activation of the detonator at the point of closest approach, the circuit of FIG. 5 must examine the input waveform arriving from coil 16 of FIG. 2 for the following characteristics:

(1) Signal amplitude. The circuit must determine that the signal voltage 26 has risen above the predetermined threshold level 28.

(2) Zero cross-over. If the amplitude of the input signal 26 has risen above the predetermined threshold level 28, then the circuit must initiate a firing pulse to the detonator at the time of zero cross-over—that is, the point of closest approach of the missile to the target.

(3) Polarity. The circuit of FIG. 5 must function on waveforms that are initially of either voltage polarity (achieved by the push-pull arrangement of the transistors 30 and 32).

(4) Validity of the input signals. The circuit of FIG. 5 must provide discrimination against spurious signals, such as noise pulses 29 shown in FIGS. 3 and 4.

To achieve the above objectives, the circuit of FIG. 5 incorporates an input stage (a) which is driven push-pull by the detection coil 16 to produce an amplified negative-polarity signal output. The circuit also includes a second stage (b) which is a clipper-amplifier held initially at cut-off and receiving a positive feedback from a thirdstage phase-inverter (c) to result in a square wave output to a firing signal accumulator capacitor (d). The charge on this capacitor accumulated during the intial rise and fall of the signal waveform is delivered to an output stage (e) as a trigger voltage occurring during the time of closest approach of the missile to the target. The output stage, a power switch, then discharges one or more firing capacitors (f) through a detonator circuit (g).

The two functions (a) and (b) are performed by the input portion of the circuit of FIG. 5, which consists not only of the transistors 30 and 32 but also of the resistors 34, 36, and 38 and the capacitors 40 and 42. The transistors 30 and 32 have their emitter electrodes interconnected, and are intended to be operated in a nonlinear region at the knee of their base-voltage collector-current curve. Consequently, when an input voltage of either polarity is received from the sensor (such as coil 16) then there will be an increase in the current through the common collector load resistor 34. As an example of values which have been employed in actual practice, at a representative operating current level (fixed by resistor 36 at approximately 5 ua total base current) the transistor input resistance is in the order of 25,000 ohms and the DC current gain is about 60.

The collector load resistance 34 is selected when the amplifier is assembled to develop a specified voltage drop at room temperature, the value of resistor 34 being dependent on the current gain of transistors 30 and 32 at high signal levels. Thus the change in voltage across the load resistor 34 for a given input signal will be (to a first approximation) independent of the transistor current gain.

Figure 6:
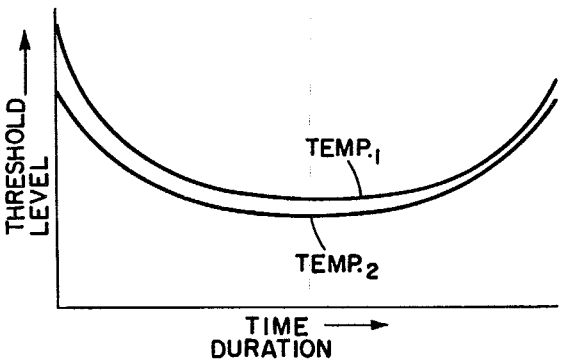
FIG. 6 is a curve representing the sensitivity of the circuit of FIG. 5 as a function of the duration of the signal voltage developed by the sensing unit of FIG. 2.

The bandwidth of the amplifier of FIG. 5 is determined by the R-C filter circuits composed of capacitor 40 together with resistor 36 and capacitor 42 in combination with resistor 38. Capacitor 42 filters high frequencies from the input to the second stage, while capacitor 40 accomplishes low-frequency roll-off by allowing degeneration through resistor 36. At operating frequency, capacitor 40 acts as a low-impedance ground for the transistor base circuits. FIG. 6 shows the temperature stability of the circuit of FIG. 5, the curves of FIG. 6 being plotted to show the circuit sensitivity (firing threshold level) at extremes of temperature as a function of the length (time duration) of the input signal.

The capacitor 42 is located in the base circuit of a further transistor 44, and hence capacitor 42 is able to provide effective high-frequency roll-off without introducing objectionable time-delay in the firing pulse. A Zener diode 46 reduces the collector voltage of the transistors 30 and 32 to an acceptable level.

The first decision function of the circuit of FIG. 5 is accomplished by the second stage (b) which consists of the transistor 44, the resistors 48 and 50, the diode 52, and the capacitor 54. The transistor 44 is connected to the emitter electrode of a fourth transistor 56 through the capacitor 54, the circuit being completed at signal frequency through this capacitor 54 and diode 52. In its normally cut-off state, the base electrode of transistor 44 is held at the potential of its emitter by the return path through resistor 48, since it conducts only leakage currents. When a sufficient input signal is introduced, the voltage across resistor 34 increases, causing a voltage to appear across resistor 48 which biases transistor 44 into conduction.

The second decision function is accomplished by the third stage (c) consisting of transistor 56, resistors 50, 58, 60 and 62, capacitors 64 and 66, diode 52 and transformer 68. Transistor 56 is normally conducting at saturation by virtue of the base current carried by resistor 50. Conduction by transistor 44 results in an increase in voltage across resistor 50, and consequently causes reverse biasing of transistor 56. When the collector current is reduced to a negligible value, capacitor 66 charges through the primary winding of transformer 68. Resistor 62 is included to lower the circuit "Q" and to reduce ringing. When the signal voltage declines, transistor 44 is again cut off, and transistor 56 now conducts to saturation. The charge accumulated by capacitor 66 (the firing pulse) is then transferred through the transformer 68 to a silicon-controlled rectifier 70 (which may be a solid-state thyratron) as a short-rise-time, positive-voltage pulse. The switching action of transistor 56 is greatly enhanced by positive feedback to transistor 44 through capacitor 64, and through capacitor 54 as a result of the change in the Zener current of diode 52. The change in the Zener voltage of diode 52, however, must be less than the base bias of transistor 44 if proper switching action is to occur.

The fourth amplifier stage is, as above stated, a silicon-controlled rectifier 70 which amplifies and relays the firing pulse developed on capacitor 66 so as to energize the detonator circuit 72. The latter may be of any known design. The resistor 74 is merely for the purpose of limiting the current flow to the detonator circuit when the rectifier 70 conducts.

Obviously many modifications and variations of the present invention are possible in the light of the above teachings. It is therefore to be understood that within the scope of the appended claims the invention may be practiced otherwise than as specifically described.

I claim:

1. In a circuit for detonating a projectile at its point of closest approach to a target toward which the projectile has been launched, said projectile incorporating a sensor for developing an electrical wave which increases in magnitude as the projectile approaches the target and then drops to zero at the point of closest approach of the projectile to the target in the event that there is no contact therebetween, said circuit comprising:

(a) a balanced push-pull input amplifier receiving the electrical wave developed by said sensor and acting to generate a signal output of negative polarity as the said electrical wave drops to zero following a rise in amplitude as the projectile approaches its target;

(b) a clipper-amplifier to which the signal output of said push-pull input amplifier is applied, said clipper-amplifier being initially cut off and being rendered conductive by the application thereto of the output of said push-pull amplifier to develop a square-wave voltage;

(c) a phase inverter connected to said clipper-amplifier and providing positive feedback thereto;

(d) an energy-storage device receiving the square-wave voltage developed by said phase inverter and acting to generate a firing signal;

(e) a power switch actuated to closed position by the firing signal produced by said energy-storage device when said firing signal has reached a a predetermined value;

(f) a projectile detonator;

(g) and a network including said projectile detonator and said power switch, said network being energized by the closing of said power switch to detonate said projectile.

2. A projectile-detonating circuit according to claim 1 in which said balanced push-pull input amplifier includes a pair of transistors, the electrical wave developed by said sensor being concurrently applied with opposite polarity to the respective base electrodes of said transistor pair.

3. A projectile-detonating circuit according to claim 2, in which the pair of transistors included in said push-pull input amplifier have a common collector load resistor across which an output signal is generated.

4. In a circuit for detonating a projectile at its point of closest approach to a target toward which the projectile has been launched, said projectile incorporating a sensor for developing an electrical wave which increases in magnitude as the projectile approaches the target and then drops to zero at the point of closest approach of the projectile to the target in the event that there is no contact therebetween, said circuit comprising:

(a) a balanced push-pull input amplifier receiving the electrical wave developed by said sensor and acting to generate a signal output of negative polarity as the said electrical wave drops to zero following a rise in amplitude as the projectile approaches its target, said push-pull amplifier including a pair of transistors, the electrical wave developed by said sensor being concurrently applied with opposite polarity to the respective base electrodes of said transistor pair, said pair of transistors having a common collector load resistor across which an output signal is generated;

(b) a clipper-amplifier to which the output signal of said push-pull input amplifier is applied, said clipper-amplifier being initially cut off and being rendered conductive by the application thereto of the output of said push-pull input amplifier to develop a square-wave voltage;

(c) a phase inverter connected to said clipper-amplifier and providing positive feedback thereto, said phase inverter including a further transistor normally conducting at saturation and having its base electrode connected to said clipper-amplifier, said further transistor being reverse-biased by conduction of said clipper-amplifier to reduce the transistor collector current to a negligible value;

(d) an energy-storage device receiving the square-wave voltage developed by said phase inverter and acting to generate a firing signal;

(e) a power switch actuated to closed position by the firing signal produced by said energy-storage device when said firing signal has reached a predetermined value;

(f) a projectile detonator;

(g) and a network including said projectile detonator and said power switch, said network being energized by the closing of said power switch to detonate said projectile.

5. The combination of claim 4 further including a transformer connected between said energy-storage device and said power switch, and means for charging said energy-storage device through the primary winding of said transformer when the collector current of said further transistor is reduced to a negligible value by conduction of said clipper-amplifier.

* * * * *